US005169032A

United States Patent [19]

Steijns et al.

[11] Patent Number: 5,169,032

[45] Date of Patent: Dec. 8, 1992

[54] TAMPER EVIDENT SPRAYER/NOZZLE ASSEMBLY

[75] Inventors: Emile B. Steijns, Lierop; Wilhelmus J. S. Maas; Petrus L. W. Hurkmans, both of Someren, all of Netherlands

[73] Assignee: AFA Products Inc., Forest City, N.C.

[21] Appl. No.: 840,785

[22] Filed: Feb. 24, 1992

[51] Int. Cl.[5] ..... B67B 5/32

[52] U.S. Cl. ..... 222/153; 222/380; 222/383

[58] Field of Search ..... 222/153, 380, 383, 384

[56] References Cited

U.S. PATENT DOCUMENTS

| | | | |
|---|---|---|---|
| 3,910,463 | 10/1975 | Reese | 222/153 |
| 4,204,614 | 5/1980 | Reeve | 222/153 |
| 4,257,561 | 3/1981 | McKinney | 222/153 X |
| 4,310,105 | 1/1982 | Gach | 222/153 |
| 4,376,497 | 3/1983 | Mumford | 222/153 |
| 4,516,695 | 5/1985 | Garneau | 222/380 X |
| 4,946,074 | 8/1990 | Grogan | 222/153 |
| 4,971,227 | 11/1990 | Knickerbocker et al. | 222/380 X |
| 5,050,779 | 9/1991 | Knickerbocker | 222/153 |

*Primary Examiner*—Kevin P. Shaver
*Attorney, Agent, or Firm*—Thomas R. Vigil

[57] ABSTRACT

The trigger operated fluid dispensing device is adapted to be mounted to a container. The device comprises a body having a top wall portion and front end portion. A nozzle assembly is provided at the front of the body and comprises a nose bushing at the front end of the body and a nozzle cap rotatably mounted to the nose bushing. The nozzle cap has blocking structure that is engageable with structure that prevents rotation of the nozzle cap. A pull-away piece is detachably connected to the top wall portion of the body and has extending structure extending into the area between the nozzle cap and the front end of the body for engaging the blocking structure for preventing relative movement between the nozzle cap and the body.

19 Claims, 5 Drawing Sheets

TAMPER EVIDENT SPRAYER/NOZZLE ASSEMBLY

BACKGROUND OF THE INVENTION

1. Field of the Invention

The present invention relates to a trigger operated dispensing device, e.g. a trigger sprayer, for mounting to a storage container. A pumping mechanism inside the dispensing device is actuated by a trigger to pump liquid out of the storage container into the discharge end of the dispensing device. A nozzle assembly is attached to the discharge end and includes a nozzle cap rotatable to three different discharge positions. A STOP position closes the discharge end, a STREAM position enables a focused stream discharge of liquid, and a SPRAY position enables a fog-like discharge of liquid.

Conventional dispensing devices or trigger sprayers, respectively, can be actuated while on a store shelf to spray liquid on a passerby or on the floor, thereby creating a hazardous condition. Therefore, it is advantageous to have a tamper proof or tamper evident nozzle assembly on the dispensing device to avoid any abuse before the bottle and the dispensing device reaches the final user.

More specifically, the present invention relates to a tamper evident/tamper proof sprayer/nozzle assembly for ensuring that the nozzle cap remains in its STOP position and to provide evidence whether or not the dispensing device has been tampered with.

2. Description of the Related Art Including Information disclosed under 37 CFR § 1.97-1.99.

Heretofore, various trigger sprayers have been proposed.

Two examples of previously proposed trigger sprayers having tamper proof or tamper evident structure thereon are disclosed in the following two patents:

| U.S. Pat. No. | Patentee |
|---|---|
| 4,946,074 | Grogan |
| 4,971,227 | Knickerbocker et al. |

In the Grogan U.S. Pat. No. 4,946,074 a tamper evident manually actuated pump sprayer is disclosed, which includes a locking device extending between the trigger and a confronting portion of the pump body and abuts against a trigger flange. When pushing the trigger, the locking device breaks and falls apart so that it is impossible to replace the locking device after having squeezed the trigger. In another embodiment, the device engages the underside of the trigger and snap fits into a sprayer nozzle cap located adjacent the trigger. After pulling off this locking device, some projections will remain within the nozzle without interfering with intended use.

In the Knickerbocker et al U.S. Pat. No. 4,971,227 a manually actuated sprayer is disclosed, having a nozzle rotatable from OFF to ON positions. A removable tear strip or a removable cap is provided for preventing rotation from the OFF position. Upon removal of the tear strip or cap, the nozzle is free to be rotated to its ON position. By removing the tear strip, it is destroyed and therefore, it cannot be replaced, which provides evidence to the user that the nozzle has been tampered with. The tear strip is almost an extension of the body of the dispensing device and molded thereto. The tear strip covers partially the nozzle cap and since the tear strip is fixed on the body of the dispensing device, the nozzle cap cannot be rotated without removing the tear strip beforehand.

The dispensing device of the present invention differs from these previously proposed structures by providing a tamper evident/tamper proof nozzle assembly that includes a different type of tamper evident/tamper proof structure and is thereby distinguished over the teachings of the Grogan and Knickerbocker et al. patents.

As will be described in greater detail hereinafter, the tamper evident/tamper proof nozzle assembly of the present invention includes a pull-away piece mounted to a trigger sprayer body and having fork arms that extend into the body through mating spaced apart slots in the top of the body at the front end thereof and in a top side wall of the nozzle cap thereby preventing rotation of the nozzle cap. Additionally, the fork arms prevent manipulation of the body to disengage child resistant means therein for enabling the nozzle cap to be rotated.

SUMMARY OF THE INVENTION

According to the present invention there is provided a trigger operated fluid dispensing device for mounting to a container. The dispensing device comprises a body having a top wall portion and a front end portion. A nozzle assembly is provided at the front of the body and comprises a nose bushing at the front end of the body and a nozzle cap rotatably mounted to the nose bushing. The nozzle cap has blocking structure that is engageable with structure that prevents rotation of the nozzle cap. A pull-away piece is detachably connected to the top wall portion of the body and has extending structure extending into the area between the nozzle cap and the front end of the body for engaging the blocking structure for preventing relative movement between the nozzle cap and the body. Breaking of or removal of the pull-away piece is evidence that the nozzle cap may have been tampered with.

DESCRIPTION OF THE PREFERRED EMBODIMENT(S)

Figure 1:
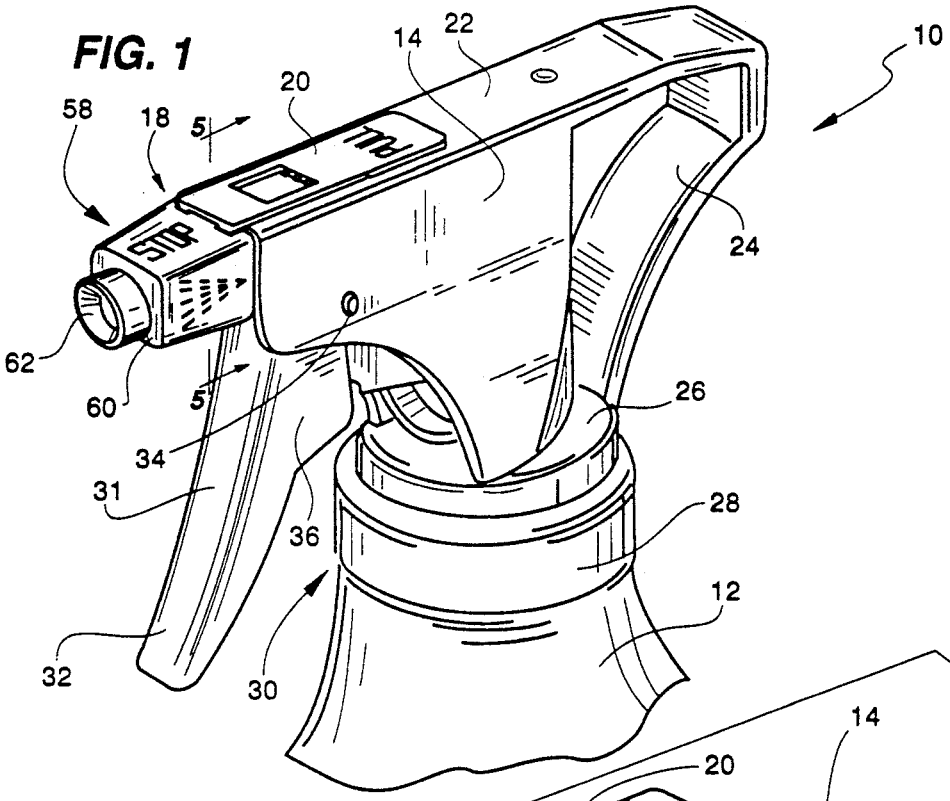
FIG. 1 is a perspective view of a trigger sprayer constructed according to the teachings of the present invention.

Referring now to the drawings in greater detail, there is illustrated in FIG. 1 a perspective view of an all synthetic/plastic trigger sprayer 10 coupled to a bottle 12.

Figure 2:
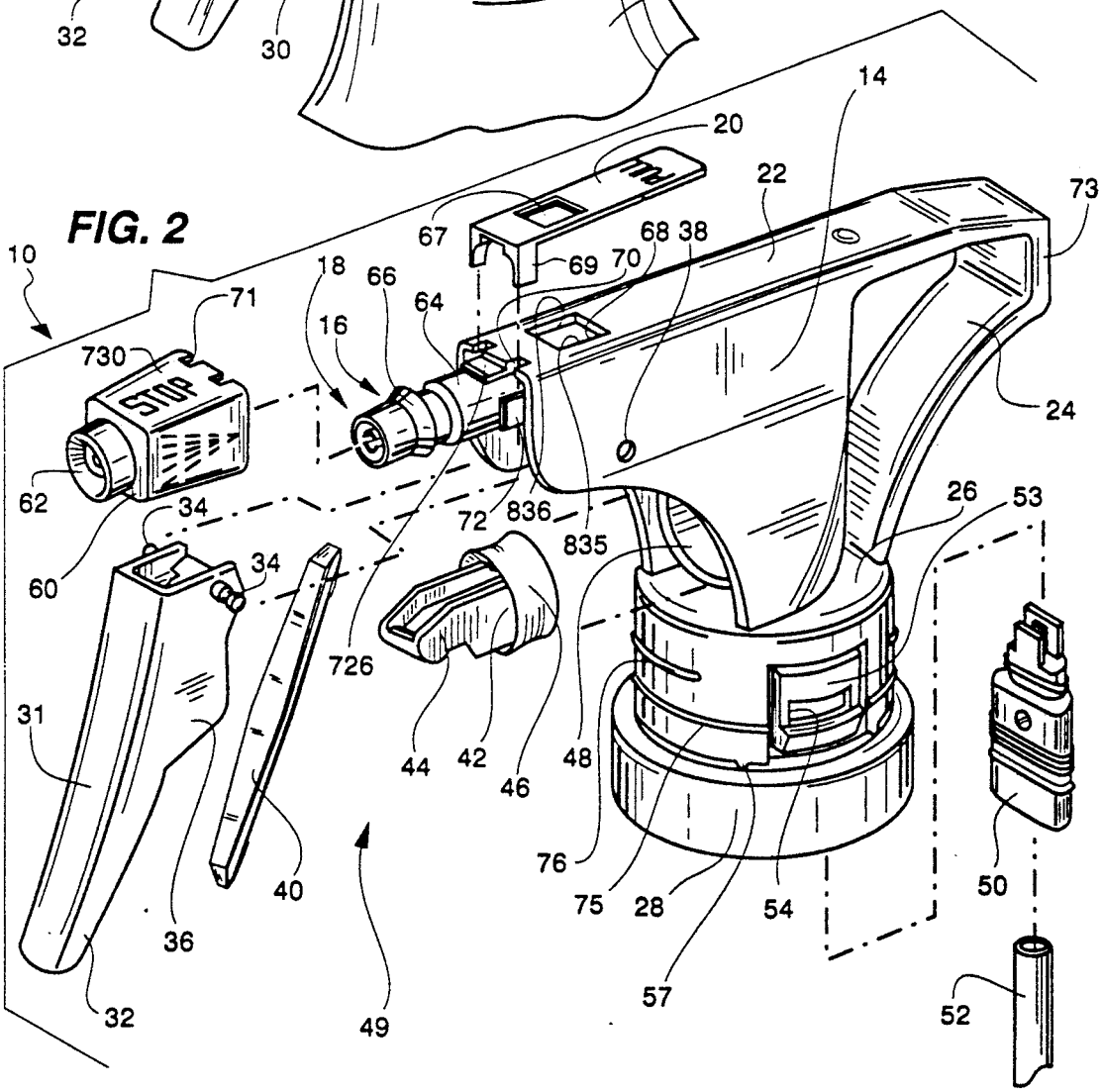
FIG. 2 is an exploded perspective view of the trigger sprayer shown in FIG. 1 and shows a lower locking ring prior to its detachment from a cylindrical base of the sprayer body.

An exploded perspective view of the parts of the trigger sprayer 10 is shown in more detail in FIG. 2.

The trigger sprayer 10 includes a body 14, a nose bushing 16 at a discharge end 18 of the body 14, a nozzle tamper proof or tamper evident pull-away piece 20, a top portion 22 and a hand gripping formation 24 extending rearwardly from the top portion 22 of the body 14 and then downwardly to a cylindrical base 26 of the body 14. The base 26 is held by a locking ring 28 to a neck 30 of the bottle 12.

A trigger 32 having a front side 31 is pivotally mounted to the body 14 by having two cylindrical pins 34, molded on the top end of two opposed side walls 36 of the trigger 32, inserted into two corresponding holes 38 in the body 14 of the trigger sprayer 10.

As shown in FIG. 2, a plastic spring assembly 40 is placed between the body 14 and the trigger 32 to urge the trigger 32 always back into its home position. Coupled to the trigger 32 is a piston 42 having an outer piston rod 44 which connects with the trigger 32 and an inner cylindrical end 46 which is received in a cylindrical opening 48 in the body 14 for the purpose of varying the volume in a pumping chamber defined in the opening 48.

The trigger 32, the spring assembly 40, the piston 42 and the cylindrical opening 48 form and define primary components of a pumping mechanism 49.

A valve intake stem 50 is received into the bottom of the cylindrical base 26 and has a dip tube 52 releasably fixed thereto and depending therefrom for insertion into the bottle 12.

A safe and child resistant sprayer/bottle connection is provided and includes locking tabs 53 with lug receiving openings 54 formed in the cylindrical side wall of the cylindrical base 26 and cooperating locking lugs on the bottle neck 30 and locked in place by the locking ring 28.

When the molded sprayer body is removed from a mold, the locking ring 28, connected to the cylindrical base 26 of the body 14 by six links, points, fillets or webs 57 which are necessary for molding the locking ring 28 together with the body 14 is broken away from the cylindrical base 26 by breaking the fillets 57 and moved upwardly on the base. During assembly of the parts of the trigger sprayer 10, the locking ring 28 is moved downwardly over the cylindrical base 26.

A nozzle assembly 58 is provided and includes a rotatable nozzle cap 60 having a forwardly extending cylindrical extension 62. The nozzle cap 60 is mounted on the nose bushing 16 extending from a cylindrical portion 64 of the body 14 and includes an annular band 66 for holding the nozzle cap 60.

Three different positions of the nozzle cap 60, a STOP position, a SPRAY position, and a STREAM position are provided.

When the nozzle assembly 58 is mounted to the body 14, a mounting block 67 of the piece 20 is snap fittingly received through an opening 68 in the top portion 22. At the same time, fork arms 69 of the piece 20 extend through notches 70 in the top portion 22 and/or notches 71 in the top wall of the cap 60 between one of two flexible locking legs or prongs 72 and the cylindrical portion 64 for securing the nozzle cap 60 in its STOP position, thereby ensuring a tamper proof and child resistant locking of the trigger sprayer nozzle assembly 58 to the body 14.

The nozzle assembly 58 is mounted on the discharge end 18 of trigger sprayer 10, as described above. The top portion 22 of the body 14 extends rearwardly to a rear end 73 of the hand gripping formation 24 and then slants forwardly and downwardly from the rear end 73 to the cylindrical base 26.

The six contact fillets or webs 57 are uniformly distributed around the lower end of the cylindrical base 26 and are initially integral with the locking ring 28. During the molding process, the contact fillets or webs 57 are broken and the locking ring 28 is moved upwardly relative to the cylindrical base 26. Later, when the locking ring 28 is moved downwardly on the base 26, an annular groove within the locking ring 28 snap-fittingly mates with an annular rib 75 on the base 26. The upper position of the locking ring 28 is the pre-application-to-a-bottle position and the locking ring 28 is held in this position by frictional engagement of the inner wall of the locking ring 28 with the rib segments 76 provided on the outer cylindrical wall of the cylindrical base 26. The upper, partially annular rib segments 76 on the outer cylindrical wall of the cylindrical base 26 locate and to some extent limit upward movement of the locking ring 28.

Figure 3:
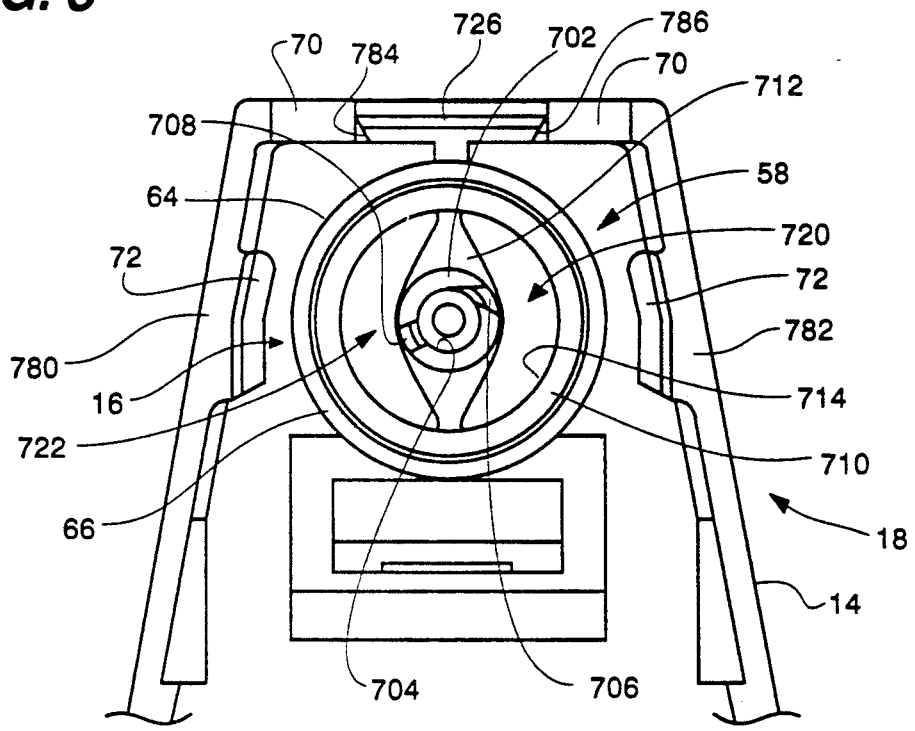
FIG. 3 is a front elevational view of the front end of the sprayer body and a nose bushing that extends from the front end of the body of the trigger sprayer shown in FIG. 2, but without a pull-away piece mounted at the front end of the body.

Referring now to FIG. 3, which is a front elevational view of the nose bushing 16, it will be apparent that the nose bushing 16 includes a cylindrical extension 702 having an inner cylindrical cavity 704. The cylindrical extension has a first slot 706 through the cylindrical wall thereof which is a so-called tangential slot for directing liquid tangentially into the cylindrical cavity 704 and has a second, so-called radial, slot 708 for directing liquid radially into the cylindrical cavity 704.

The cylindrical extension 702 is small-in-diameter and is located coaxially with an outer cylinder 710 having a larger diameter. In the embodiment shown in FIG. 3, the smaller cylindrical extension 702 extends outwardly from a web 712 of material which fixes the cylindrical extension 702 in the position shown and defines between, an inner wall 714 of the outer cylinder 710, two waterways 720 and 722 which communicate liquid to be sprayed in a SPRAY or STREAM to the tangential slot 706 or to the radial slot 708.

Figure 4:
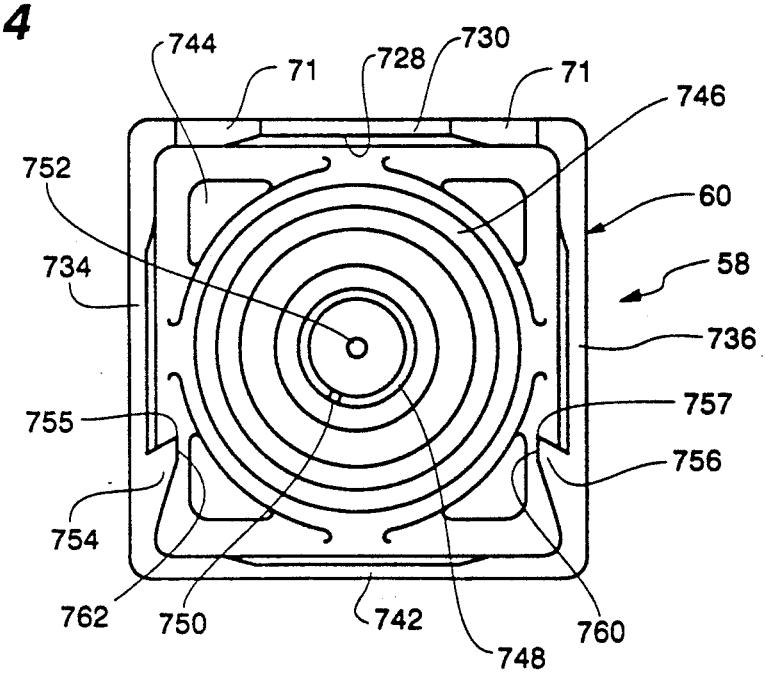
FIG. 4 is a back elevational view of the nozzle cap of a nozzle assembly shown in FIG. 2.

Also, it will be apparent from FIG. 3 that the top of the body 14 between the slot 70 has a tab extension 726 which extends partially into a locating slot 728 in the back underside of a top side 730 wall of the nozzle cap 60 as shown in FIG. 4.

With reference to FIG. 4, it will be seen that the nozzle cap 60 has a generally square configuration with the top side wall 730 having STOP indicating indicia. A left side wall 734 has SPRAY indicating indicia. thereon and a right side wall 738 which has STREAM indicating indicia.

Also, the nozzle cap 60 has a bottom wall 742, as shown in FIG. 4.

Within the envelope of the forward portions of the walls 730, 734, 736 and 742 and extending rearwardly from a front wall 744 of the nozzle cap 60 is a first outer cylinder 746 which is adapted to receive therein the outer cylinder 710 of the nose bushing 16. Then, also extending rearwardly from the front wall 744 within the outer cylinder 710 is a smaller-in-diameter cylinder 748 having a slot 750 extending radially therethrough which is adapted, upon selective rotation of the nozzle cap 60, to mate with either the tangential slot 706 or the radial slot 708 in the cylindrical extension 702. The smaller-in-diameter cylinder 748 is adapted to be received over the cylindrical extension 702.

In a manner which is conventional in the art, when the nozzle cap 60 is rotated counterclockwise 90° from the STOP position to the SPRAY position, liquid in the waterway 720 will pass through the slot 750 and through the mating slot 706 into the cylindrical cavity 704 and in a swirl forwardly to an outlet orifice 752 in the front wall 744 of the nozzle cap 60.

In a similar manner, when the nozzle cap 60 is rotated clockwise 90° from the STOP position to the STREAM position, the slot 750 in the wall of the cylinder 748 will mate or register with the radial slot 708 whereby liquid can flow from the waterway 722 through the slot 750 and through the slot 704 radially into the cylindrical cavity 704 and then axially forwardly and out of the orifice 752.

In this way, in a manner similar to previously proposed nozzle assemblies, liquid can be directed through the waterways 720 and 722 to selectively aligned, axially extending or radially extending, slots for communicating liquid in a swirl or in an axial path to the orifice 732 for effecting a desired discharge of liquid in either a conical spray or mist-like discharge or in a substantially axial STREAM type discharge.

Also, it will be understood that different formations can be utilized for effecting the mating of one or more tangential slots through a radial slot to a waterway or one or more radial slots to a radial or longitudinal slot and thence to a waterway, as disclosed in the Quinn et al U.S. Pat. No. 4,234,128 or the Dobbs et al U.S. Pat. No. 4,706,888, the disclosures of which are incorporated herein by reference.

Also in FIG. 4, there is illustrated a first formation 754 in the lower area on the inside of the side wall 734. This formation 754 defines a lug, boss or detent 754 that extends angularly upwardly and inwardly from the wall 734 inside the nozzle cap 60 to an edge or catch 755. In like manner, a lug, boss or detent 756 in the lower area of the wall 736 extends inwardly from the wall 736 inside the nozzle cap 60 to an edge or catch 757.

As will be described in greater detail hereinafter, the lugs 754 and 756 normally are positioned in the nozzle assembly 58 beneath the legs or prongs 72.

Figure 6:
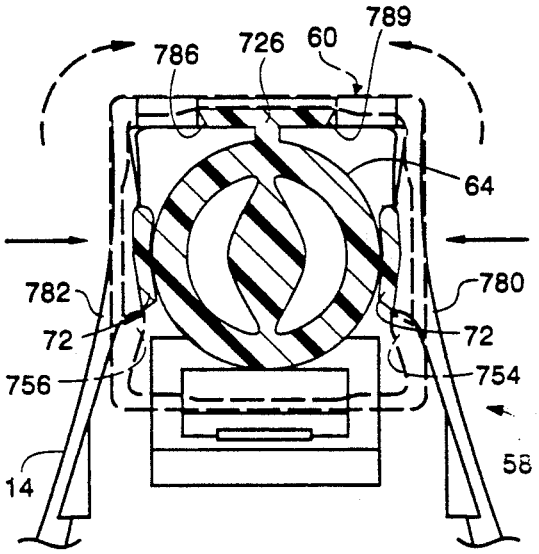
FIG. 6 is a vertical sectional view through the nozzle assembly, similar to the view shown in FIG. 5, but showing the side walls of the sprayer body squeezed in to move two legs or prongs extending from the body out of blocking position relative to two lugs on the inner wall of the nozzle cap.

The blocking engagement of the legs or prongs 72 relative to the lugs or projections 754 and 756 normally prevents rotation of the nozzle cap 60 of the nozzle assembly 58 until the pull-away piece 20 is pulled away to remove the fork arms 69 from the locking position of each fork arm between the cylindrical portion 64 and one leg or prong 72, and unless and until a user squeezes the side walls of the body 14 in the side wall areas 780 and 782, such squeezing of the wall areas 780 and 782 being shown in FIG. 6, at the same time the user rotates the nozzle cap 60.

Figure 5:
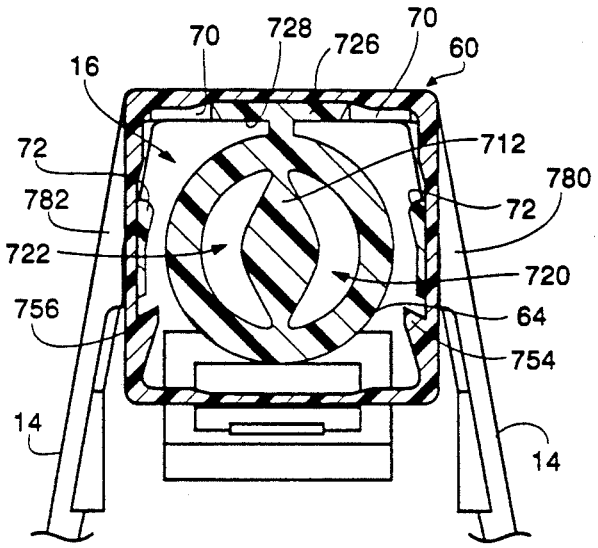
FIG. 5 is a vertical sectional view through the nozzle assembly shown in FIG. 1 after a pull-away piece is removed and is taken along line 5—5 of FIG. 1.

The blocking position of the prongs 72 is shown in FIG. 5. Then, as shown in FIG. 6, when the wall areas 780 and 782 of the body 14 are squeezed or pushed inwardly to move the legs or prongs 72 toward the cylindrical portion 64 and out of blocking or catching engagement with the lugs 754 and 756, the nozzle cap 60 can be rotated clockwise or counterclockwise, as shown in phantom in FIG. 6.

Each lug 754, 756 has an upper surface 760 extending to a surface 762 that is close to parallel to the plane of the side wall 734 or 736, the intersection of these surfaces 760, 762 being the edge or catch 755 or 757.

It will be noted that the extension tab 726 having inclined side edges 784 and 786 is adapted to engage, on one side or the other, the lug 754 or the lug 756 to prevent further rotation of the nozzle cap 60, counterclockwise or clockwise thereby to ensure that the nozzle cap 60 can only be moved from the STOP position to the SPRAY position or from the STOP position to the STREAM position.

Figure 7:
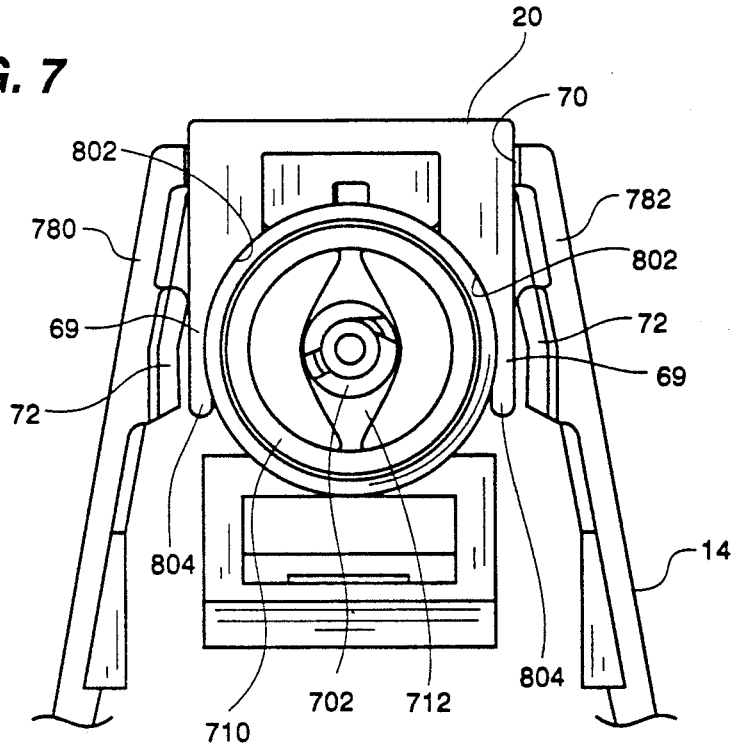
FIG. 7 is a front end elevational view of the sprayer body and the nose bushing that extends from the front end of the body of the trigger sprayer shown in FIG. 2, similar to FIG. 3, but with a pull-away piece mounted at the front end of the body.

In the assembly of the trigger sprayer 10, after the nozzle cap 60 is mounted on the nose bushing 16, the pull-away piece 20 is mounted at the front end of the sprayer body 14 with the nozzle cap 60 having the side wall 730 with the STOP indicia 732 thereon facing upwardly so that the nozzle assembly 58 is in the STOP position With reference to FIGS. 2 and 7, it will be understood that the mounting block 67 of the pull-away piece 20 has a generally rectangular planar body 801 and is pressed downwardly after placement over the top portion 22 to snap-fittingly lock the mounting block 67 in the opening 68 in the top portion 22 of the body 14. At the same time, the fork arms 69, each having a curved inner surface 802, are received through the spaced apart slots or notches 70 in the top portion 22 at the front end thereof and through the slots or notches 71 in the rear edge of the top wall 730 of the nozzle cap 60, with the curved surfaces 802 being received around the cylindrical portion 64 of the body 14 and having lower ends 804 received between the cylindrical portion 64 and the spaced apart legs or prongs 72.

With the lower ends 804 of the fork arms 69 positioned in this manner, inward movement of the legs or prongs 72 when the wall areas 780 and 782 of the body 14 are squeezed is prevented.

As a result, if one tried to rotate the nozzle cap 60, such rotation is prevented, on the one hand by the fork arms 69 extending through the mating slots or notches 70 and 71 in the top wall portion 22 of the body 14 and the top wall 730 of the nozzle cap 60 and, on the other hand, by the blocking position of the fork arms 69 which prevent inward movement of the prongs 72 to enable the lugs 754 and 756 to be moved past the prongs 72 upon either clockwise or counterclockwise attempted rotation of the nozzle cap 60.

Figure 8:
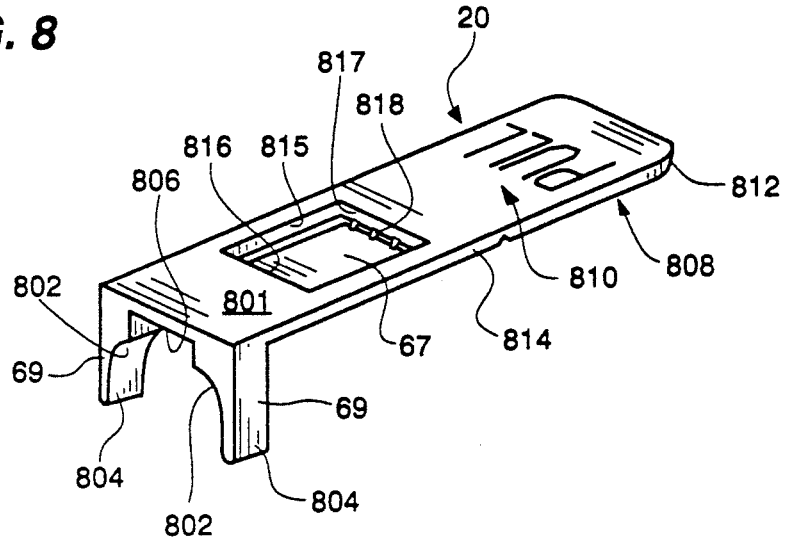
FIG. 8 is a perspective view of the pull-away piece mounted at the front end of the body and constructed according to the teachings of the present invention.

As best shown in FIG. 8, the pull-away piece 20 has at the front end thereof a rectangular recess 806 which is adapted to be received over the extension tab 726. The curved surfaces 802 extend downwardly and laterally on the inner side of the form arms 69 from the edges of the rectangular recess 806.

A top rear portion or pull tab 808 of the pull-away piece 20 has PULL indicia 810 thereon.

Further, to facilitate pulling of the pull-away piece 20, the rear underside of the pull tab 808 is beveled upwardly at 812 as shown in FIGS. 8, 10, 11 and 12.

Figure 9:
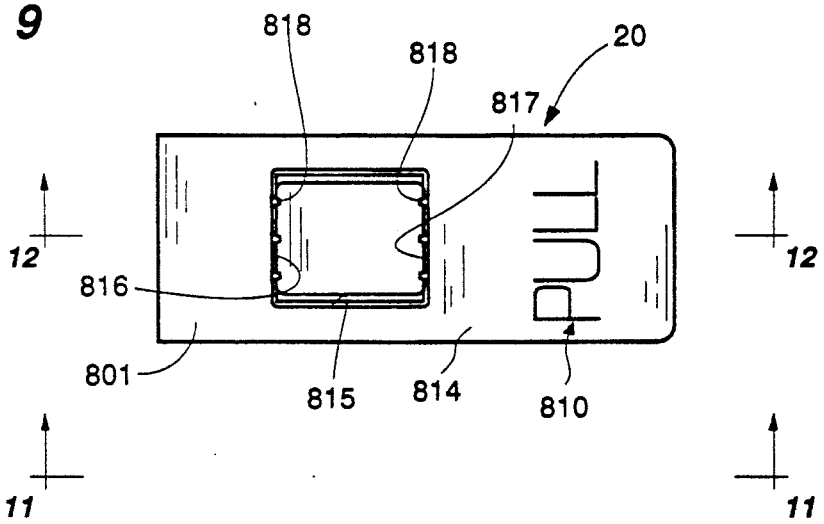
FIG. 9 is a top plan view of the pull-away piece shown in FIG. 8.
Figure 10:
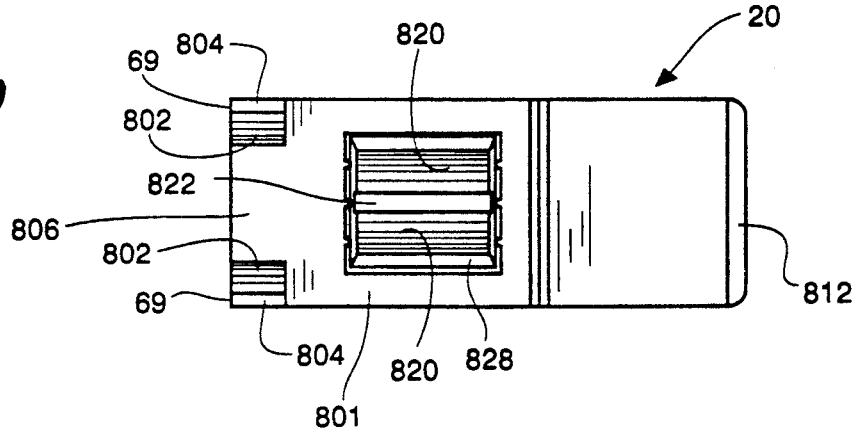
FIG. 10 is a bottom plan view of the pull-away piece shown in FIG. 8.

The mounting block 67 is positioned below the planar body 801 of the pull-away piece 20 beneath a recess 815 in the planar body 801 and is connected to front and back edges 816, 817 of this recess 815 by three webs or fillets 818, as best shown in FIG. 9.

Figure 14:
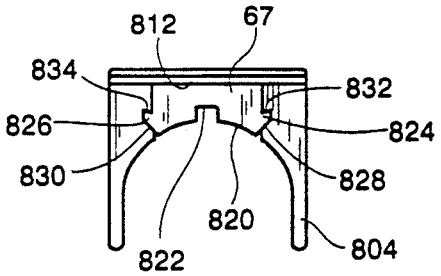
FIG. 14 is a back elevational view of the pull-away piece and is taken along line 14—14 of FIG. 12.
Figure 15:
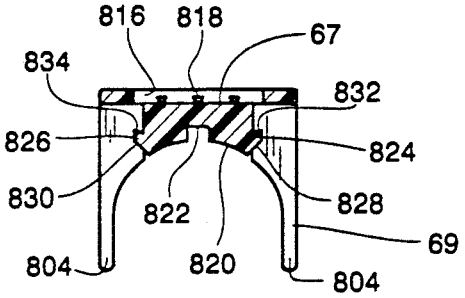
FIG. 15 is a vertical sectional back view of the pull-away piece and is taken along line 15—15 of FIG. 11.

The mounting block 67 has a curved lower surface 820 with a central longitudinally extending slot 822 separating the mounting block 67 into left and right prong portions 824 and 826. Each prong portion 824 and 826 has an inclined surface 828, 830 which inclines upwardly and laterally outwardly from the curved surface 820 to a shoulder 832, 834, as best shown in FIGS. 14 and 15.

It will be understood that when the mounting block 67 is pushed downardly through the opening 68, the inclined surfaces 828 and 830 engage the sides of the opening 68 and the slot 822 allows the prong portions 824 and 826 to be deflected inwardly until the shoulders 832 and 834 are moved past lower side edges 835 and 836 of the opening 68 and snap into a locking position beneath the top wall portion 22 of the body 14 adjacent the side edges 835, 836 of the opening 68. The curved surface 820 will then rest upon the upper surface of the cylindrical portion 64 perhaps with a slight interference fit between the cylindrical portion 64 and the underside of the top wall surface 22.

Figure 11:
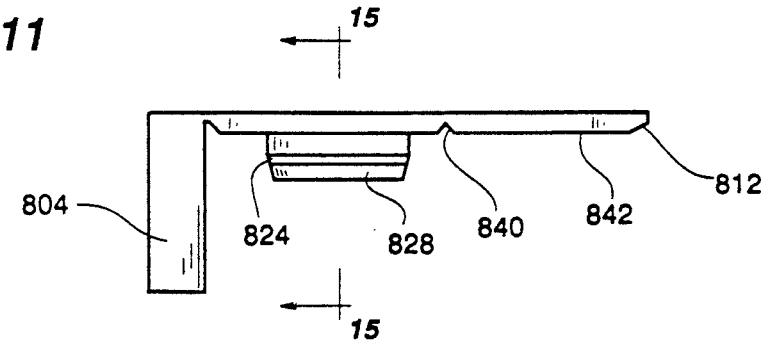
FIG. 11 is a side elevational view of the pull-away piece shown in FIG. 8 and is taken along line 11—11 of FIG. 9.
Figure 12:
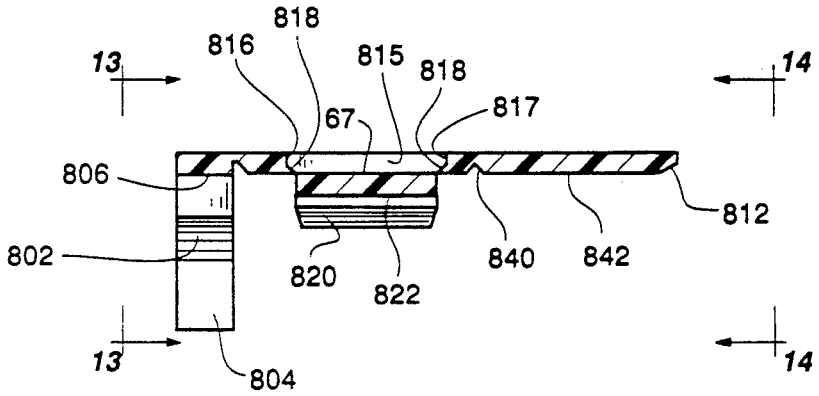
FIG. 12 is a longitudinal vertical sectional side view of the pull-away piece shown in FIG. 8 and is taken along line 12—12 of FIG. 9.
Figure 13:
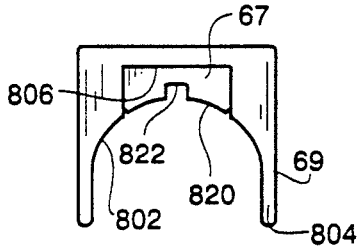
FIG. 13 is a front elevational view of the pull-away piece and is taken along line 13—13 of FIG. 12.

As shown in FIGS. 11 and 12, the planar bottom portion 801 has a transverse groove 840 in a lower surface 842 thereof to facilitate bending of the pull tab 808.

The pull-away piece 20 provides tamper evident structure for the nozzle assembly 58. In this respect, if the pull-away piece 20 is broken or missing, that is evidence that the nozzle assembly of the trigger sprayer has been tampered with.

In use, a user will grip the pull tab 808 at the rear end of the break away piece 20 and pull upwardly, with the bevel 812 facilitating gripping of the pull tab 808 and the transverse groove 840 facilitating bending of the pull tab 808 upwardly. As the pull tab 808 is pulled upwardly, first the webs or fillets 818 at the back edge 817 of the recess 815 are broken followed by breaking of the webs or fillets 818 at the front edge 816 of the recess 815. After the webs or fillets 818 are broken, the pull-away piece 20 can be easily removed from the sprayer body to remove the fork arms 69 from the mating slots or notches 71 and 72 and to remove the lower ends 804 of the fork arms 69 from a blocking position between the cylindrical portion 64 and the legs or prongs 72 to enable a user to use the trigger sprayer 10.

From the foregoing description, it will be apparent that the nozzle assembly 58 and the pull-away piece 20 of the present invention provide a tamper evident/tamper proof nozzle assembly for a trigger sprayer since the nozzle cap 60 cannot be rotated until the pull-away piece 20 is pulled out to remove the fork arms 69 from the slots or notches 70 and 71 and from their position between the prongs or legs 72 and the cylindrical portion 64 of the nose bushing 16 to permit inward deflection of the legs or prongs 72 when the body 14 is squeezed in the side wall areas 780 and 782 to move the legs or prongs 72 inwardly so that the nozzle cap 60 can be rotated from the STOP position to either the SPRAY position or the STREAM position.

Also, it will be apparent from the foregoing description that modifications can be made to the trigger sprayer 10, the nozzle assembly 58 and the pull-away piece 20 of the present invention for providing a child resistant sprayer without departing from the teachings of the present invention. Accordingly, the scope of the invention is only to be limited as necessitated by the accompanying claims.

We claim:

1. A trigger operated fluid dispensing device for mounting to a container, said dispensing device comprising:

a body having a top wall portion and front end;

a nozzle assembly on said body comprising a nose bushing at said front end of said body and a nozzle cap rotatably mounted to said nose bushing;

said nozzle cap having blocking means engageable by extending structure that prevents rotation of said nozzle cap; and, a pull-away piece detachably connected to said top wall portion of said body and having said extending structure extending into the area between said nozzle cap and said front end of said body for engaging said blocking means for preventing relative movement between said nozzle cap and said body.

2. The dispensing device of claim 1 wherein said top wall portion has an opening therein and said pull-away piece has a body portion and a mounting block which is frangibly connected to said body portion and which is snap fittingly received in said opening.

3. The dispensing device of claim 2 wherein said mounting block has frangible spaced apart webs or fillets at a front edge of said block and at a rear edge of said block frangibly connecting said block to said body portion.

4. The dispensing device of claim 2 wherein said mounting block has two spaced apart prong portions which are deflectable inwardly of said block, each prong portion having an inclined surface for engaging a side edge of said opening in said top wall portion when said block is pushed into said opening and a shoulder at an upper end of said inclined surface for engaging the underside of said top wall portion after said mounting block is snap fittingly received in said opening for preventing said block from being pulled out of said opening.

5. The dispensing device of claim 2 wherein said body portion is generally planar and includes a rearwardly extending pull tab.

6. The dispensing device of claim 5 wherein said body portion of said pull-away piece has a transverse groove therein between said pull tab and the remainder of said body portion to facilitate upward bending of said pull tab for pulling said pull-away piece from said top portion of said body.

7. The dispensing device of claim 5 wherein said pull tab is bevelled at a lower rear edge thereof to facilitate engaging same with a finger.

8. The dispensing device of claim 1 wherein said blocking means comprises first passage means in said nozzle cap, said front end having second passage means facing said first passage means, and said extending structure is configured to fit simultaneously into both said first and said second passage means to prevent relative rotation between said nozzle cap and said body until said pull-away piece is removed said second passage means defining at least part of said blocking.

9. The dispensing device of claim 8 wherein said first and second passage means are defined by a pair of spaced apart notches in a rear edge of an upper wall of said nozzle cap and a pair of mating spaced apart notches in a front edge of said top wall portion of said body, respectively, and said extending structure is defined by a pair of fork arms extending from a body portion of said pull-away piece and located to be received in said mating notches.

10. The dispensing device of claim 1 wherein said body has opposed side walls, said nose bushing extends from said front end between said side walls and said body has projection means extending therefrom for engaging said nozzle to engage and prevent rotation of said nozzle cap upon rotation of said cap without squeezing of said body side walls; cooperating means on or in said nozzle cap and on or in said nose bushing for selectively establishing three rotated positions of said nozzle cap including a stop or off position of said nozzle cap, a spray position of said nozzle cap and a stream position of said nozzle cap upon rotation of said nozzle cap; said nozzle cap having engaging means therein for engaging said projection means when someone attempts to rotate said nozzle cap without squeezing said body side walls; and, said side walls of said body being deflectable inwardly of said body so that when said side walls are squeezed inwardly, they engage and move inwardly said projection means to permit said engaging means in said nozzle cap to move past said projection means when said nozzle cap is rotated at the same time said side walls are squeezed, said projection means defining structure that prevents rotation of said nozzle cap and said nozzle cap engaging means defining at least part of said nozzle cap blocking means.

11. The dispensing device of claim 10 wherein said projection means includes at least one leg or prong extending outwardly from said front end of said body adjacent one of said side walls.

12. The dispensing device of claim 11 wherein said extending structure of said pull-away piece comprises at least one arm which extends into the area between said leg or prong and said nose bushing to prevent inward deflection of said leg or prong until said pull-away piece is removed to remove said arm from blocking movement of said leg or prong toward said nose bushing to permit rotation of said nozzle cap.

13. The dispensing device of claim 10 wherein said nozzle cap is generally cup-shaped including at least three side walls and a front wall, said front wall having an outlet orifice therein and at least one of said side walls having on an inner surface thereof a lug, defining said engaging means, positioned to engage said projection means.

14. The dispensing device of claim 10 wherein said body has a top side wall and a tab extending from said top wall at the front end of said body and adapted to be received in said nozzle cap beneath the top wall thereof and having side edges at least one of which is adapted to engage said engaging means inside said nozzle cap to limit rotation of said nozzle cap with such engagement defining an operating position of said nozzle assembly.

15. The dispensing device of claim 10 wherein the area between said front end and said nozzle cap has respective first and second mating passage means in said nozzle cap and said front end defined by a pair spaced apart notches in a rear edge of an upper wall of said nozzle cap and a pair of mating spaced apart notches in a front edge of said top wall portion of said body, respectively, said blocking means comprises said first passage means, said extending structure of said pull-away piece is defined by a pair of fork arms extending from a body portion of said pull-away piece and received through said mating notches, first and second legs or prongs diametrically disposed on opposite sides of said nose bushing and extending outwardly from said front end of said body with each leg or prong being disposed adjacent each of said side walls, and each fork arm is received between one side wall of said body and one of said legs or prongs to prevent inward deflection of said leg or prong until said pull-away piece is removed to remove each arm from blocking movement of said leg or prong toward said nose bushing to permit rotation of said nozzle cap.

16. The dispensing device of claim 15 wherein each of said legs or prongs is a generally flat flexible planar elongate leg which extends in a plane close to parallel to the plane of an adjacent side wall of said body and being deflectable inwardly toward said nose bushing when said side walls are squeezed thereby to move said legs or prongs out of a blocking position with respect to said engaging means in said cap.

17. The dispensing device of claim 15 wherein said nozzle cap is generally cup-shaped including at least three side walls and a front wall, said front wall having an outlet orifice therein, said side walls comprising a top side wall, a left side wall and a right side wall, and said left and right side walls each having on an inner surface thereof a lug positioned to engage the side of one of said legs or prongs, said lugs defining said engaging means.

18. The dispensing device of claim 17 wherein each of said lugs is defined by a projection which extends outwardly from the inner surface of one of said nozzle cap side walls on the lower portion of said side wall and having a sharp edge or catch edge defined between a first surface extending inwardly from said inner surface of said nozzle cap side wall and another surface close to parallel to said nozzle cap side wall.

19. A trigger operated fluid dispensing device for mounting to a container, said dispensing device comprising:

a body having a top wall portion and front end;

a nozzle assembly at said front of said body comprising a nose bushing at said front end of said body and a nozzle cap rotatably mounted to said nose bushing;

an elongate pull-away piece having a middle portion detachably connected to said top wall portion of said body at a point rearwardly of said front end, having a rear, finger grippable, portion extending rearwardly from said middle portion, and having a front portion extending forwardly from said middle portion, said front portion having engaging means for engaging said nozzle cap for preventing relative movement between said nozzle cap and said body until said rear portion is pulled forwardly and upwardly to detach said middle portion of said pull-away piece from said top wall portion and move said front portion out of engagement with said nozzle cap.

* * * * *

UNITED STATES PATENT AND TRADEMARK OFFICE

CERTIFICATE OF CORRECTION

PATENT NO. : 5,169,032

DATED : December 8, 1992

INVENTOR(S) : Emile B. Steijns, Wilhelmus J.S. Maas, Petrus L.W. Hurkmans

It is certified that error appears in the above-identified patent and that said Letters Patent is hereby corrected as shown below:

Column 2, line 27 "portion." should be --portion,--.

Column 5, line 11 "indicia." should be --indicia--.

Column 6, line 42 "7" should be --15--.

Column 7, line 7 "form" should be --fork--.

Column 9, line 8 "removed said second passage means defining at least part of said blocking." should be --removed--.

Signed and Sealed this

Seventeenth Day of May, 1994

*Attest:*

Bruce Lehman

BRUCE LEHMAN

*Attesting Officer*

*Commissioner of Patents and Trademarks*